US012584189B2

(12) United States Patent
Mochizuki et al.

(10) Patent No.: US 12,584,189 B2
(45) Date of Patent: Mar. 24, 2026

(54) MOLTEN METAL MIXING SYSTEM

(71) Applicant: Tounetsu Co., Ltd., Shizuoka (JP)

(72) Inventors: Kiyata Mochizuki, Shizuoka (JP); Tomihiro Iwamoto, Shizuoka (JP)

(73) Assignee: Tounetsu Co., Ltd., Shizuoka (JP)

( * ) Notice: Subject to any disclaimer, the term of this patent is extended or adjusted under 35 U.S.C. 154(b) by 372 days.

(21) Appl. No.: 18/035,228

(22) PCT Filed: Jul. 30, 2021

(86) PCT No.: PCT/JP2021/028385
§ 371 (c)(1),
(2) Date: May 3, 2023

(87) PCT Pub. No.: WO2022/102177
PCT Pub. Date: May 19, 2022

(65) Prior Publication Data

US 2023/0272504 A1 Aug. 31, 2023

(30) Foreign Application Priority Data

Nov. 13, 2020 (JP) ..... 2020-189243

(51) Int. Cl.
*C22B 7/00* (2006.01)
*B22D 35/00* (2006.01)

(52) U.S. Cl.
CPC ..... *C22B 7/00* (2013.01); *B22D 35/00* (2013.01)

(58) Field of Classification Search
CPC ... F27B 3/04; F27B 3/045; C22B 7/00; C22B 7/001; C22B 7/002; C22B 7/003;
(Continued)

(56) References Cited

U.S. PATENT DOCUMENTS

2009/0249919 A1* 10/2009 Degel ..... F27B 3/085 75/10.35

FOREIGN PATENT DOCUMENTS

JP H02038538 A 2/1990
JP H06273050 A 9/1994
(Continued)

OTHER PUBLICATIONS

International Search Report for PCT/JP2021/028385, mailed Sep. 14, 2021.

*Primary Examiner* — Ricardo D Morales
(74) *Attorney, Agent, or Firm* — Andrus Intellectual Property Law, LLP

(57) ABSTRACT

A molten metal mixing system capable of controlling generation of oxides in mixing of molten metals to. The system includes 1st/2nd apparatus for melting 1st/2nd raw materials into 1st/2nd molten metals, and a pipe connecting the 1st and 2nd apparatus. The 2nd molten metal produced in the 2nd apparatus is transferred through the pipe to the 1st apparatus to mix with the 1st raw material and/or the 1st molten metal. The 2nd apparatus has a tapping chamber for retaining the 2nd molten metal to be transferred to the 1st apparatus. The 1st apparatus has a receiving chamber for retaining the 2nd molten metal transferred from the 2nd apparatus. When part of the 2nd molten metal is discharged out of the receiving chamber to lower the surface of the molten metal, the 2nd molten metal in the tapping chamber is transferred through the pipe into the receiving chamber by siphon principle.

16 Claims, 8 Drawing Sheets

(58) Field of Classification Search
CPC ..... C22B 9/003; C22B 9/16; B22D 35/00;
B22D 35/04; B22D 35/06
See application file for complete search history.

(56) References Cited

FOREIGN PATENT DOCUMENTS

| | | | |
|---|---|---|---|
| JP | H09241774 | A | 9/1997 |
| JP | 5237752 | B2 | 7/2013 |

* cited by examiner

[FIG.1]
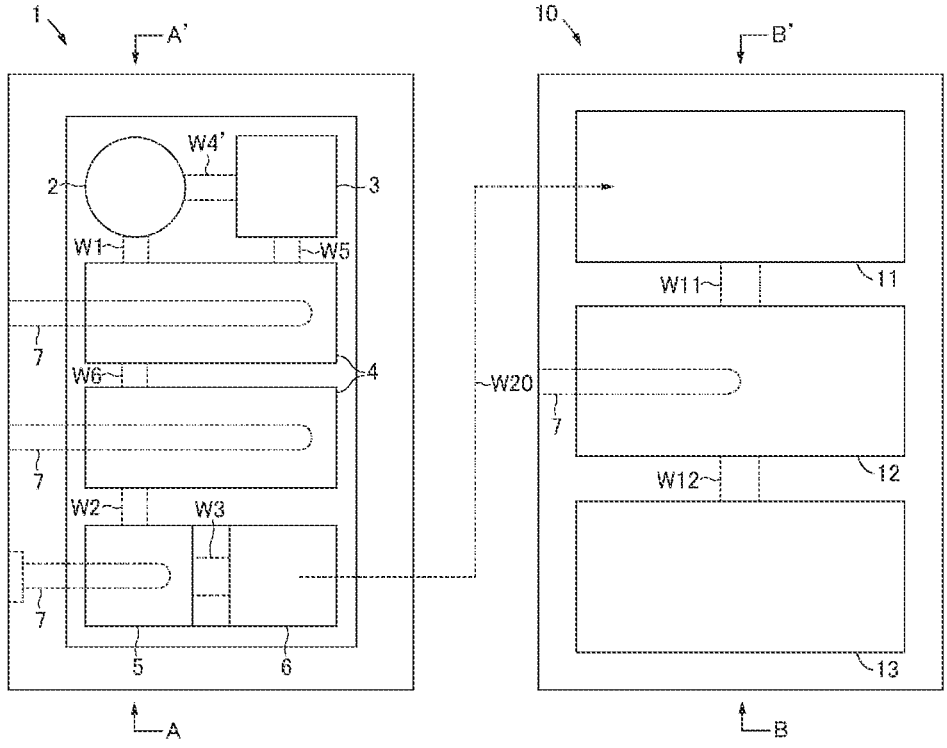

[FIG.2]
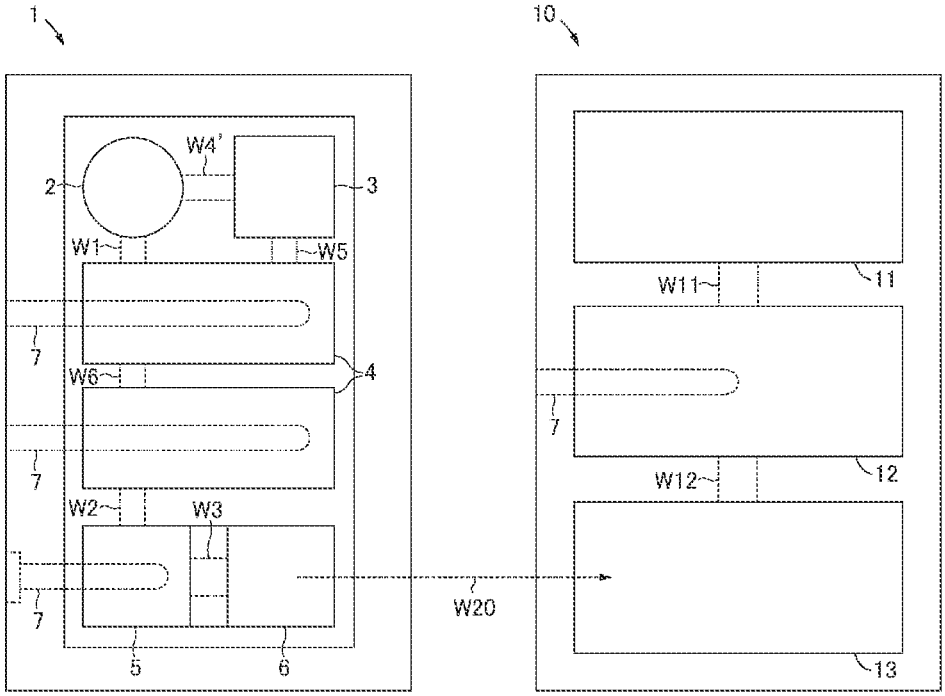

[FIG.3]
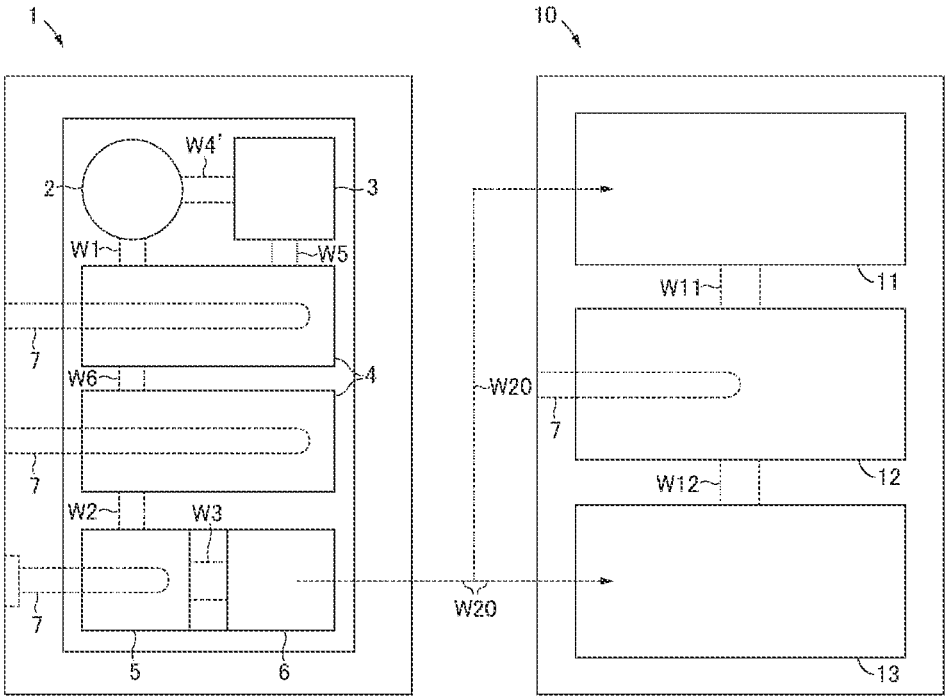

[FIG.4]
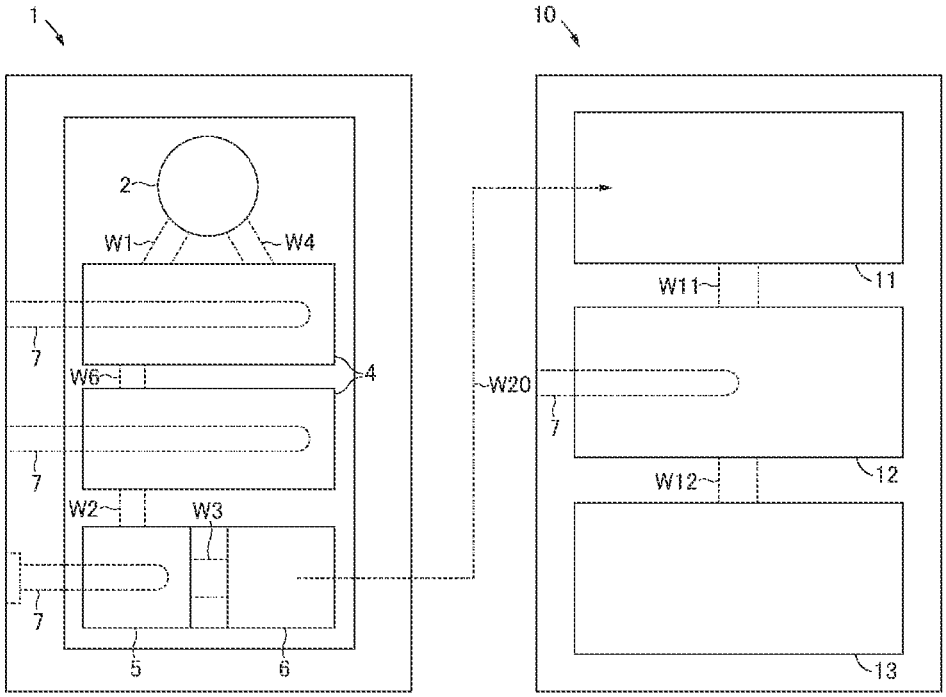

[FIG.5]
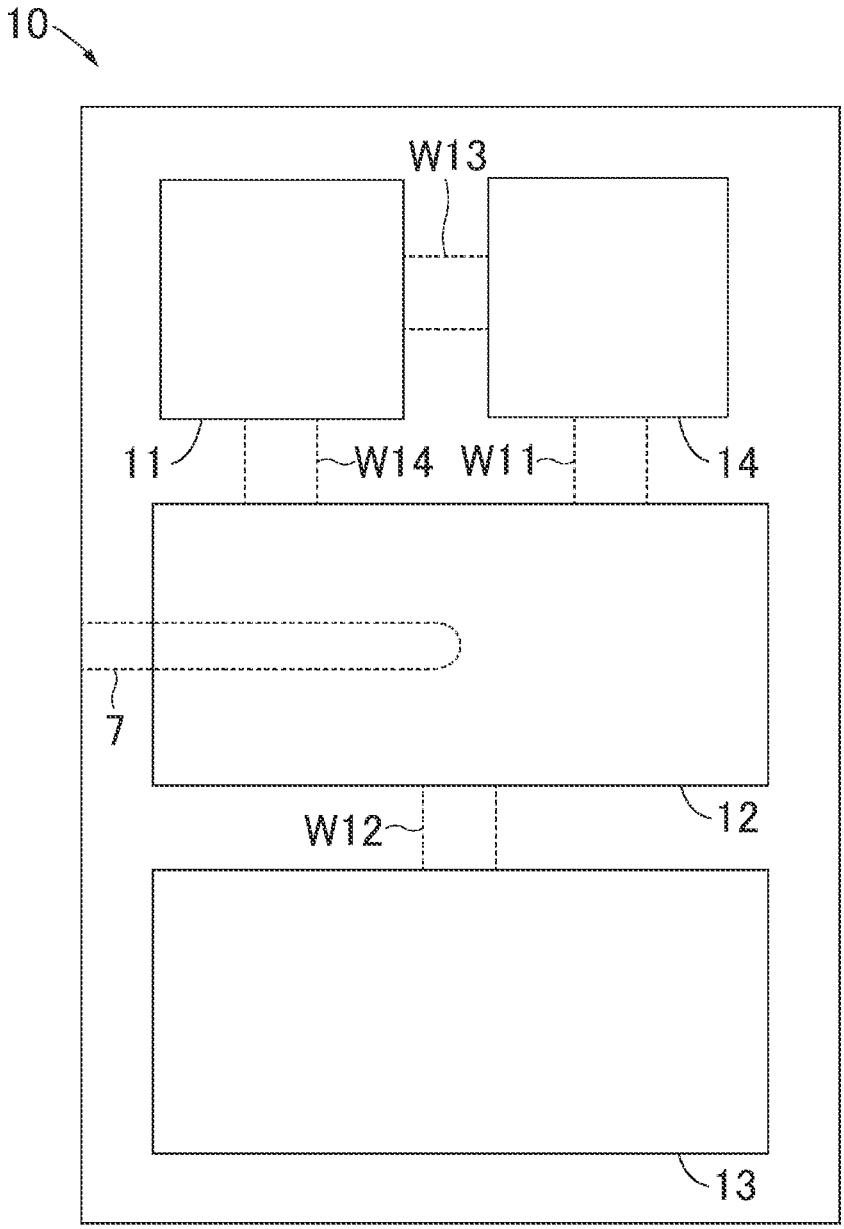

[FIG.6]
(6A)
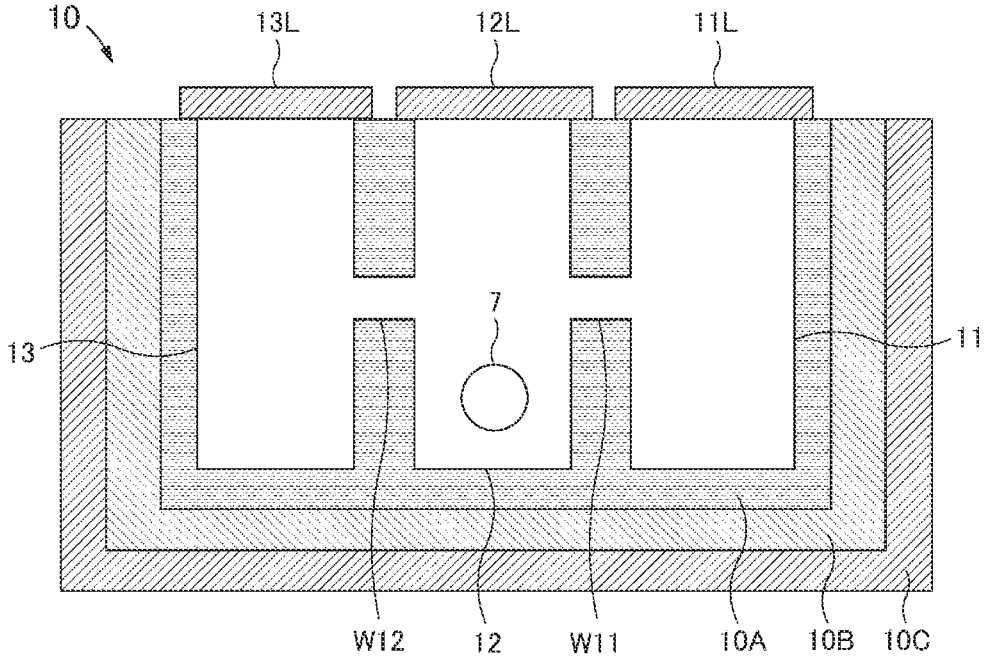
(6B)
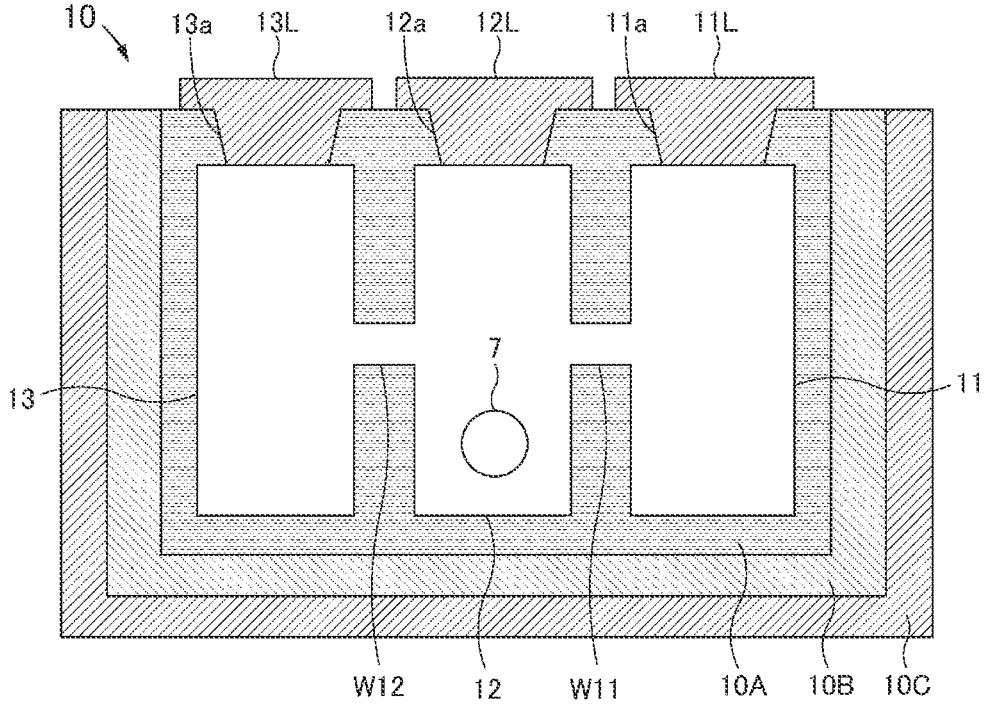

[FIG.7]
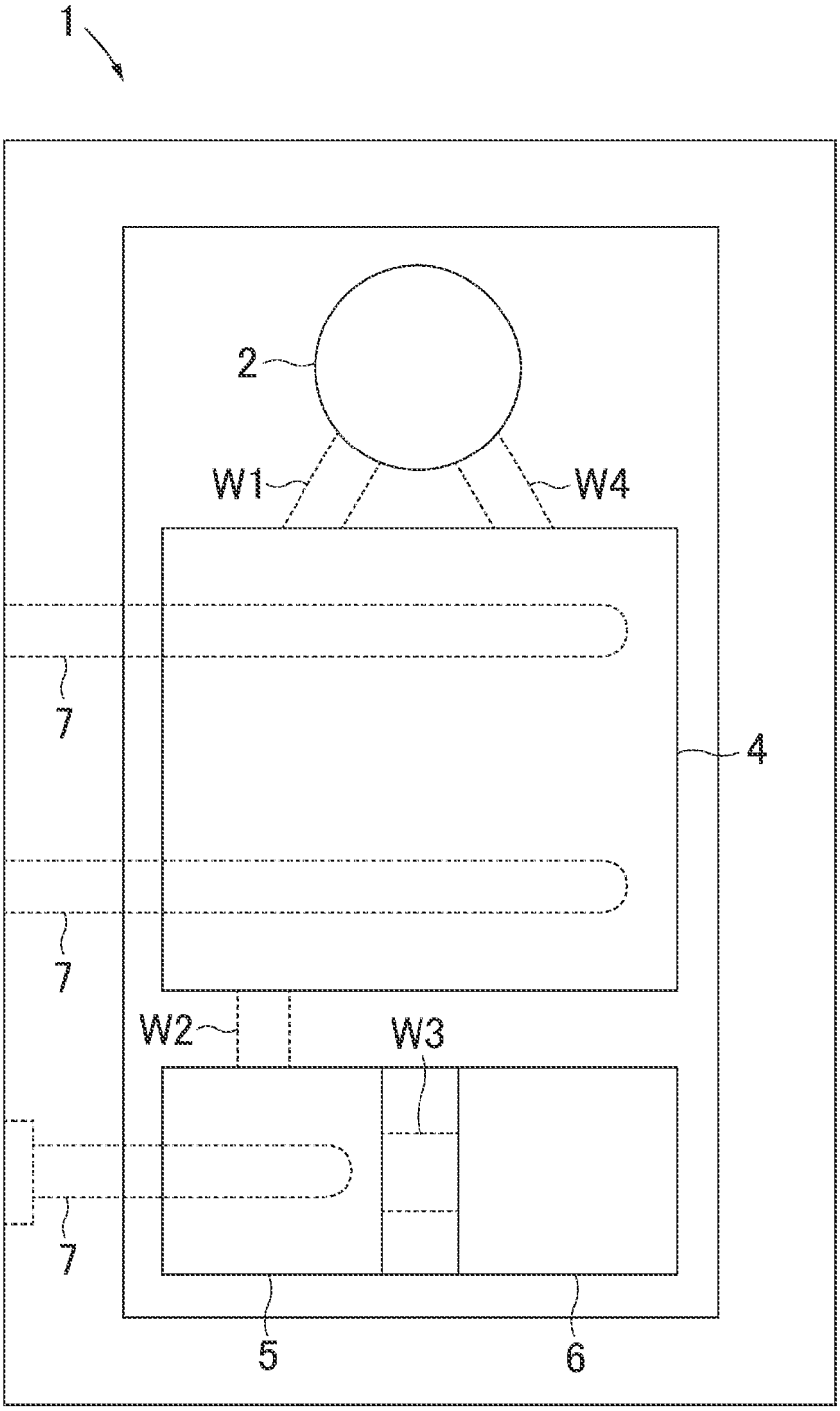

[FIG.8]
(8A)
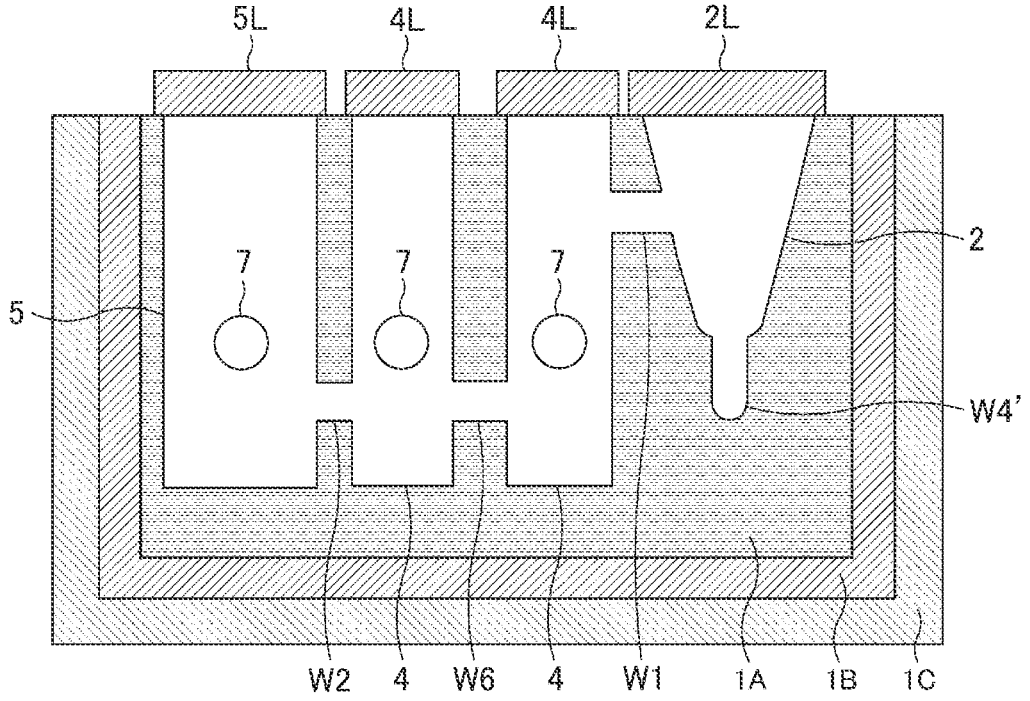
(8B)
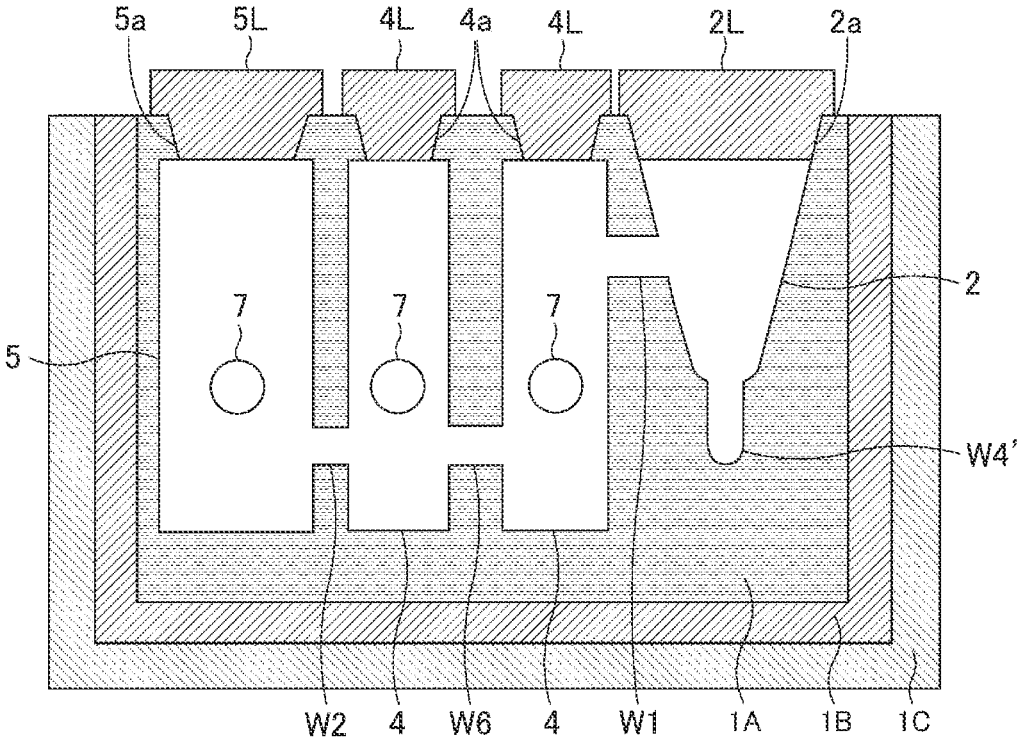

MOLTEN METAL MIXING SYSTEM

CROSS-REFERENCE TO RELATED APPLICATIONS

This application is the U.S. national stage application of International Application PCT/JP2021/028385, filed Jul. 30, 2021, which international application was published on May 19, 2022, as International Publication WO 2022/102177 in the Japanese language. The International Application claims priority of Japanese Patent Application No. 2020-189243, filed Nov. 13, 2020. The international application and Japanese application are both incorporated herein by reference, in entirety.

FIELD OF ART

The present invention relates to a molten metal mixing system in which a 1st melt raw material is melted in a 1st melting apparatus to produce a 1st molten metal, whereas a 2nd melt raw material is melted in a 2nd melting apparatus to produce a 2nd molten metal, and then the 1st and 2nd molten metals are mixed.

BACKGROUND ART

Iron has hitherto been a common material for molten metal. Recently, however, vehicles have been under body weight saving for the purpose of improved fuel efficiency, and the rate of non-ferrous metals having relatively lower specific gravities, such as aluminum materials and aluminum alloy materials, used in vehicle bodies has been growing. This leads to increasing resource value of non-ferrous metals, and increasing concerns for effective use of such precious non-ferrous metals. Based on such concerns, a method is demanded of mixing used non-ferrous metals to fresh non-ferrous metals (fresh material) to reduce the amount of fresh non-ferrous metals to be used.

The used non-ferrous metals as mentioned above may include, for example, scrap materials, such as return scrap, briquette material, and machining chips. Among the scrap materials, return scrap, which may be, for example, unnecessary portions generated during casting or during processing following casting of non-ferrous metals, followed by pulverization in a pulverizer, has properties similar to those of fresh material, and is thus convenient for melting with fresh material into molten metal. Briquette material may be, for example, cutting wastes, machining chips, and the like, generated in processing non-ferrous metals and compressed into lumps.

As such, there are a wide variety of used non-ferrous metals, among which some are easy to recycle while some others are difficult to recycle. Specifically, return scrap is relatively easy to recycle as discussed above, while briquette material and machining chips tend to be difficult to recycle. The reasons are as follows.

In general, briquette material, which is made by compressing cutting wastes, machining chips, and the like, generated in processing non-ferrous metals, into lumps as discussed above, contains oil and water, and thus cannot be made into molten metal of high quality, if melted as it is. Accordingly, for recycling, briquette material is preferably pretreated by drying or otherwise for removing oil and water contained therein through evaporation, but is yet hard to be melted into molten metal in the manner similar to that for fresh material. Further, briquette material has a lower specific gravity and a larger surface area, and thus easily floats on the surface of the molten metal and is partly prone to oxidization during melting.

Similarly, machining chips also have a lower specific gravity and a larger surface area, and thus easily float on the surface of the molten metal and are partly prone to oxidization during melting. For example, aluminum materials and aluminum alloys easily turn into oxides, like aluminum oxide ($Al_2O_3$). In particular, having a larger surface area, machining chips tend to have more oxide per unit weight. This results in the entire machining chips including the oxides to have an elevated melting point by the impact of the oxides, and become hard to melt. For example, aluminum oxide has a melting point of 2072° C., and is thus very hard to melt.

As such, briquette material and machining chips, having the properties discussed above, tend to be hard to recycle as resources.

Here, a prior art publication related to the present invention is presented. Specifically, prior art related to the present invention includes, e.g., Patent Publication 1 to be mentioned below. The invention disclosed in Patent Publication 1 is use of a connecting pipe having a siphon effect, in transferring molten metal in a melt holding furnace for feeding, into a melt holding furnace for casting.

Patent Publication 1, however, merely discloses transfer of molten metal in a holding furnace into another, adjacent holding furnace, rather than a system for mixing two or more series of molten metal.

PRIOR ART PUBLICATION

Patent Publication

Patent Publication 1: JP 5237752 B

SUMMARY OF THE INVENTION

Problems to be Solved by the Invention

For recycling oxidizable briquette material or machining chips as discussed above, machining aluminum chips, for example, contaminated with water or oil, e.g., cutting oil, are first subjected to removal of water or dissolution of oil in a cleaning solution, or to calcination in a rotary kiln without oxidizing aluminum to evaporate oil or water. After that, the machining chips are introduced into a melting furnace to produce aluminum molten metal. Alternatively, machining chips may be made into briquette material without removing oil and water therefrom, and the resulting briquette material is dried after recovery of cutting oil therefrom. After that, the dried briquette material is introduced into a melting furnace to produce aluminum molten metal. Further, it is relatively common to mix this aluminum molten metal with a separate molten metal of fresh aluminum material, aluminum alloy material, or the like, or with a separate molten metal of fresh aluminum material, aluminum alloy material, or the like and return scrap thereof. Such a molten metal of briquette material or machining chips melted in a separate step is often transferred manually from a melting furnace to a holding furnace using a pail or a ladle.

During transfer of the molten metal or upon pouring the melt into a holding furnace, the molten metal is brought into contact with air and oxidized. As a result, the molten metal being transferred may be contaminated with the oxides, which disadvantageously degrades the quality of the molten metal.

For mixing a molten metal of used non-ferrous metals (briquette material or machining chips) with a molten metal of fresh non-ferrous metals (fresh material), or mixing a molten metal of used non-ferrous metals (briquette material or machining chips) with a molten metal of fresh non-ferrous metals (fresh material) and return scrap thereof, it is required to introduce the non-ferrous metals and the return scrap into a melting furnace at predetermined weights. For example, assume that 150 kg per hour of a molten metal of used non-ferrous metals (briquette material or machining chips) and 150 kg per hour of a molten metal of fresh non-ferrous metals (fresh material), i.e., a total of 300 kg per hour of molten metal, is required. This requires that 150 kg per hour of used non-ferrous metals (briquet material or machining chips) in the form of solid feedstock and 150 kg per hour of fresh non-ferrous metals (fresh material) in the form of solid feedstock be introduced into a melting furnace equipped with melting devices, such as burners or heaters. Even when flame from the melting devices, such as burners or heaters, is uniformly brought into direct contact with each type of the non-ferrous metals, the melting rate differs between the used non-ferrous metals (briquette material or machining chips) and the fresh non-ferrous metals (fresh material). In addition, in a tower-type melting furnace, the melting rate also differs between the non-ferrous metals in direct contact with the flame from the melting devices, such as burners or heaters, and those not in direct contact therewith. This is because the machining chips tend to burn instantaneously upon direct contact with the flame, resulting in oxides rather than melting, whereas the briquette material in direct contact with the flame tends to convert into oxides rather than melting. On the other hand, the return scrap, as discussed above, has properties similar to those of fresh material, and is thus convenient for melting with fresh material into molten metal, where the melting rate of the return scrap may be taken as approximating that of the fresh non-ferrous metals (fresh material). In this way, introduction of the solid feedstock not only causes difference in melting rate to result in inhomogeneous and uneven molten metal, but also causes possible failure to achieve the predetermined weight proportions (in the above-mentioned case, molten metal weight of used non-ferrous metals (briquette material or machining chips):molten metal weight of fresh non-ferrous metals (fresh material)=150 kg:150 kg=1:1).

Moreover, in mixing a molten metal of used non-ferrous metals (briquette material or machining chips) and a molten metal of fresh non-ferrous metals (fresh material), or mixing a molten metal of used non-ferrous metals (briquette material or machining chips) and a molten metal of fresh no-ferrous metals (fresh material) and return scrap thereof, the timing of introduction differs between the molten metals. As such, it is realistically difficult to achieve the desired mixing ratio (weight proportions) between the molten metal amount of the used non-ferrous metals (briquette material or machining chips) and a molten metal amount of the fresh non-ferrous metals (fresh material), or to achieve the desired mixing ratio (weight proportions) between the molten metal amount of the used non-ferrous metals (briquette material or machining chips) and a molten metal amount of the fresh non-ferrous metals (fresh material) and return scrap thereof, as the melting rate differs between the used non-ferrous metals (briquette material or machining chips) and the fresh non-ferrous metals (fresh material) and return scrap thereof, as mentioned above. For example, for mixing an amount of molten metal of the used non-ferrous metals (briquette material or machining chips) and an amount of molten metal of the fresh non-ferrous metals (fresh material) at a predetermined mixing ratio (weight proportions), in some conventional cases, the amount of molten metal of the fresh non-ferrous metals (fresh material), which has a higher melting rate, was first introduced at the predetermined mixing proportion (weight proportion), and then the amount of molten metal of the used non-ferrous metals (briquette material or machining chips), which has a lower melting rate and melts at a lower rate compared to the fresh non-ferrous metals (fresh material), was introduced at the predetermined mixing proportion (weight proportion). Such mixing by introductions at different timings tends to result in mainly a molten metal of higher quality being first transferred to the holding furnace, as the fresh non-ferrous metals (fresh material) and the return scrap thereof having a higher melting rate melt faster. After that, the molten metal resulting from melting of the used non-ferrous metals (briquette material or machining chips) having a lower melting rate is mixed, so that a molten metal of lower quality is transferred to the holding furnace. This results in that the molten metal first transferred to the holding furnace is processed in the subsequent casting process into products of higher quality (strength or the like), whereas the molten metal later transferred to the holding furnace and contaminated with the molten metal resulting from melting of the used non-ferrous metals (briquette material or machining chips) is processed in the subsequent casting process into products of probably lower quality (strength or the like). In this way, not only the quality characteristics of the molten metals, but also the quality (strength or the like) of the products from the subsequent casting process could be adversely affected.

In the above description, aluminum material and aluminum alloy materials, which are non-ferrous metals with increasing popularity, have mainly been discussed, but similar problems reside also in iron or the like, which have been commonly used in molten metals.

It is therefore a primary object of the present invention to provide a molten metal mixing system capable of controlling generation of oxides in the course of mixing a 1st molten metal obtained by melting a 1st melt raw material and a 2nd molten metal obtained by melting a 2nd melt raw material, to thereby produce a homogeneous molten metal not contaminated with oxides (or contaminated little with oxides). It is a secondary object of the present invention to provide a molten metal mixing system capable of mixing the 1st molten metal and the 2nd molten metal at predetermined weight proportions.

Means for Solving the Problems

The above-mentioned problems may be solved by the present invention discussed below, i.e., a molten metal mixing system, including:

1st melting apparatus for melting a 1st melt raw material to produce a 1st molten metal, 2nd melting apparatus for melting a 2nd melt raw material to produce a 2nd molten metal, and a connecting pipe connecting the 1st melting apparatus and the 2nd melting apparatus, wherein the system is configured to transfer the 2nd molten metal produced in the 2nd melting apparatus through interior space of the connecting pipe to the 1st melting apparatus to mix with at least one of the 1st melt raw material and the 1st molten metal in the 1st melting apparatus, wherein the 2nd melting apparatus has a molten-metal-tapping chamber for retaining therein the 2nd molten metal to be transferred to the 1st melting apparatus, wherein the 1st melting apparatus has a molten-metal-receiving chamber for retaining therein the 2nd molten metal received from the 2nd melting apparatus, and wherein the system is configured that, when part of the 2nd molten metal retained in the molten-metal-receiving chamber is discharged out of the molten-metal-receiving chamber to lower a surface of the molten metal in the molten-metal-receiving chamber, the 2nd molten metal in the molten-metal-tapping chamber is transferred through the connecting pipe into the molten-metal-receiving chamber by siphon principle.

Effect of the Invention

According to the molten metal mixing system of the present invention, generation of oxides is controlled in the course of mixing a 1st molten metal obtained by melting a 1st melt raw material and a 2nd molten metal obtained by melting a 2nd melt raw material, to thereby produce a homogeneous molten metal not contaminated with oxides (or contaminated little with oxides). Further, the 1st molten metal and the 2nd molten metal may be mixed at predetermined weight proportions, as the two components are mixed in the form of molten metals.

BRIEF DESCRIPTION OF THE DRAWINGS

FIG. 1 is a plan view of a molten metal mixing system according to the first embodiment of the present invention.

FIG. 2 is a plan view of a molten metal mixing system according to the second embodiment of the present invention.

FIG. 3 is a plan view of a molten metal mixing system according to the third embodiment of the present invention.

FIG. 4 is a plan view of a molten metal mixing system according to the fourth embodiment of the present invention (embodiment without circulation chamber 3 in 2nd melting apparatus 1).

FIG. 5 is a plan view of a molten metal mixing system according to the fifth embodiment of the present invention (embodiment with circulation chamber 14 in 1st melting apparatus 10).

FIG. 6 shows sectional views taken along lines B-B' in FIG. 1, wherein FIG. 6(A) is a first sectional view taken along lines B-B' and FIG. 6(B) is a second sectional view taken along lines B-B'.

FIG. 7 is a plan view of a molten metal mixing system according to the sixth embodiment of the present invention (embodiment wherein 2nd melting devices 4 in 2nd melting apparatus 1 according to the fourth embodiment were replaced with one 2nd melting device 4).

FIG. 8 shows sectional views taken along lines A-A' in FIG. 1, wherein FIG. 8(A) is a first sectional view taken along lines A-A' and FIG. 8(B) is a second sectional view taken along lines A-A'.

EMBODIMENTS FOR CARRYING OUT THE INVENTION

Preferred embodiments of the molten metal mixing system according to the present invention will now be explained with reference to the drawings. The descriptions below and the drawings merely show some embodiments of the present invention, which should not be interpreted as limiting the present invention.

First Embodiment

A first embodiment of the molten metal mixing system according to the present invention is shown in FIG. 1. This molten metal mixing system includes a 1st melting apparatus 10 for melting a 1st melt raw material to produce a 1st molten metal, a 2nd melting apparatus 1 for melting a 2nd melt raw material to produce a 2nd molten metal, and a connecting pipe W20 connecting the 1st melting apparatus 10 and the 2nd melting apparatus 1, wherein the system is configured to transfer the 2nd molten metal produced in the 2nd melting apparatus 1 through the connecting pipe W20 to the 1st melting apparatus 10 to mix the 1st molten metal and the 2nd molten metal in the 1st melting apparatus 10.

<1st Melting Apparatus 10>

The 1st melting apparatus 10 includes a 1st introduction chamber 11, into which the 1st melt raw material is introduced, a 1st melting chamber 12, in which the 1st melt raw material is received from the 1st introduction chamber 11 and melted into a 1st molten metal, and a 1st retention chamber 13, in which the 1st molten metal is received from the 1st melting chamber 12 and temporarily retained therein until feeding to external apparatus, such as casting apparatus or die-casting machine.

The 1st introduction chamber 11 and the 1st melting chamber 12 are connected with an 11th transfer line W11. This 11th transfer line W11 may be, for example, in the form of a hollow pipe. In the following, an embodiment is described in which the 11th transfer line W11 is a pipe, which is designated as pipe W11.

Further, as will be discussed in detail later, according to the first embodiment, in addition to the 1st melt raw material, the 2nd molten metal is also introduced into the 1st introduction chamber 11, which is also a molten-metal-receiving chamber. Thus, in the 1st introduction chamber 11, the 1st melt raw material is mixed in the 2nd molten metal in the form of liquid. The 2nd molten metal and the 1st melt raw material in the 1st introduction chamber 11 then flow into the 1st melting chamber 12 through the interior space of the pipe W11.

The 1st melt raw material flown into the 1st melting chamber 12 is heated with an immersion burner 7 installed inside the 1st melting chamber 12 to melt into the 1st molten metal. The immersion burner 7 is configured to extend through a side wall of the 1st melting chamber 12 into the inside thereof, and arranged below the surface of the molten metal retained in the 1st melting chamber 12. The immersion burner 7 is a so-called horizontal immersion burner. The immersion burner 7 has, for example, a double pipe structure inside. Specifically, hot air introduced into the immersion burner 7 from its base end portion flows along the exterior wall of the immersion burner 7 toward the tip end portion of the immersion burner 7. In the course of this travelling of the hot air, the exterior wall of the immersion burner 7 is heated, which in turn heats the molten metal and the 1st melt raw material in contact therewith. The hot air, upon thus reaching the tip end portion of the immersion burner 7, reverses its flowing direction to flow back toward the base end portion of the immersion burner 7 through the interior space of a discharge pipe arranged along the center of the immersion burner 7, and then discharged out of the immersion burner 7. With the immersion burner 7 of such a structure, heating with higher energy efficiency is realized. An embodiment with the horizontal immersion burner has been described, but the immersion burner 7 may alternatively extend through the ceiling of the 1st melting chamber 12 into the inside thereof, and arranged below the surface of the molten metal retained in the 1st melting chamber 12. The immersion burner 7 may be a so-called vertical immersion burner. Note that the immersion burner may be replaced with an immersion heater.

In this way, the 1st molten metal is produced from the 1st melt raw material in the 1st melting chamber 12. Since the 2nd molten metal is also flown from the 1st introduction chamber 11 into the 1st melting chamber 12 as discussed above, the 1st molten metal and the 2nd molten metal are mixed in the 1st melting chamber 12 to produce a mixed molten metal.

The 1st melting chamber 12 and the 1st retention chamber 13 are connected with a 12th transfer line W12. This 12th transfer line W12 may be, for example, in the form of a hollow pipe. In the following description, an embodiment is explained in which the 12th transfer line W12 is a pipe, which is designated as pipe W12.

The mixed molten metal produced in the 1st melting chamber 12 flows into the 1st retention chamber 13 through the interior space of the pipe W12. In this way, the mixed molten metal is retained in the 1st retention chamber 13. This mixed molten metal is supplied, for example, in batches or continuously to a casting apparatus or a die-casting machine or the like in the subsequent stage.

As shown in the first sectional view of FIG. 6 (FIG. 6A) taken along lines B-B', the 1st introduction chamber 11, the 1st melting chamber 12, and the 1st retention chamber 13 of the 1st melting apparatus 10 are provided with a 1st introduction chamber lid 11L, a 1st melting chamber lid 12L, and the 1st retention chamber lid 13L, respectively. The interior space of the respective chambers 11, 12, and 13 is preferably a hermetically sealed space devoid of air. Hermetically sealing the interior of the respective chambers 11, 12, and 13 to be devoid of air in this way reduces the chance for the molten metal to contact oxygen in the air, to thereby keep the molten metal from being oxidized partially. In particular, it is preferred that, as shown in the second sectional view of FIG. 6 (FIG. 6B) taken along lines B-B', a top opening 11*a* of the 1st introduction chamber 11, a top opening 12*a* of the 1st melting chamber 12, and a top opening 13*a* of the 1st retention chamber 13 individually have an upwardly flaring inner peripheral surface with the area of the opening gradually increasing upwards, and the 1st introduction chamber lid 11L, the 1st melting chamber lid 12L, and the 1st retention chamber lid 13L individually have an upwardly flaring outer peripheral surface corresponding to the upwardly flaring inner peripheral surface of the respective top openings 11*a*, 12*a*, and 13*a*, so as to be fittable from the above into the respective top openings 11*a*, 12*a*, and 13*a*. With the structures as discussed above, the 1st introduction chamber lid 11L, the 1st melting chamber lid 12L, and the 1st retention chamber lid 13L, when fit in the top openings 11*a*, 12*a*, and 13*a*, respectively, hardly form a gap, so that the molten metal in each chamber is more easily kept from being oxidized, even when the surface of the molten metal is raised up to the inner peripheral surface of the top opening 11*a*, 12*a*, and 13*a*, compared to a structure wherein an inner peripheral surface of each top opening 11*a*, 12*a*, 13*a* is vertical and an outer peripheral surface of each of the 1st introduction chamber lid 11L, the 1st melting chamber lid 12L, and the 1st retention chamber lid 13L is vertical. Further, the top openings 11*a*, 12*a*, and 13*a* may easily be closed simply by fitting from the above the 1st introduction chamber lid 11L, the 1st melting chamber lid 12L, and the 1st retention chamber lid 13L, respectively, therein. Note that the 1st introduction chamber 11 is covered with the 1st introduction chamber lid 11L, except when the 1st melt raw material is introduced therein. The 1st retention chamber 13 is closed with the 1st retention chamber lid 13L, except when the molten metal is supplied in batches or continuously to the casting apparatus or the die-casting machine or the like in the subsequent stage, or when maintenance or inspection is conducted. In this regard, however, when the 1st retention chamber 13 is provided with a connecting pipe W20 as will be discussed later, it is preferred to position the connecting pipe W20 spaced from the 1st retention chamber lid 13L so as not to be expanded/contracted due to the molten metal temperature, or so as to keep the connecting pipe W20 from being damaged by external vibration.

Further, as shown in FIGS. 6(A) and 6(B), the 1st melting apparatus 10 is preferably formed with a plurality of layers for the purpose of keeping the molten metals in the respective chambers 11, 12, and 13 from leaking outside, or keeping heat of the molten metals from conducting to outside (thermal insulation), or the like. In FIGS. 6A and 6B, the 1st melting apparatus 10 is shown to have a three-layered structure, but may have a two-layered or a four- or more layered structure. The innermost layer (inner layer) 10A is provided mainly for the purpose of keeping the molten metal from penetrating, and is composed of a material, such as alumina ($Al_2O_3$) or silicon dioxide ($SiO_2$) The outermost layer (outer layer) 10C is provided mainly for the purpose of thermal insulation, and is formed of a heat insulating material layer composed of a laminated sheet of refractory fabric. Positioned between the inner layer 10A and the outer layer 10C is a layer (intermediate layer) 10B, which is provided for the purpose of blocking the molten metal from reaching the outer wall when cracks are formed, and is composed of, for example, a refractory material having a higher thermal insulation capacity, compared to that of the inner layer 10A. Incidentally, the outer periphery, the bottom face, and part of the top face of the outer layer 10C is covered with, for example, an outer wall made of iron (steel shell).

The 1st introduction chamber 11, the 1st melting chamber 12, and the 1st retention chamber 13 are connected with the pipes W11 and W12, respectively, and the air pressures in the respective chambers 11, 12, and 13 are approximately the same, so that the surface levels of the molten metal in the respective chambers 11, 12, and 13 are generally the same.

From this state, when part of the mixed molten metal in the 1st retention chamber 13 is discharged out of the 1st melting apparatus 10, the surface level of the mixed molten metal in the 1st retention chamber 13 is lowered. Then, for compensating for this fall of the surface level of the molten metal in the 1st retention chamber 13, the 2nd molten metal is automatically transferred from the 2nd melting apparatus 1 into the 1st introduction chamber 11 (molten-metal-receiving chamber). The 2nd molten metal transferred into the 1st introduction chamber 11 (molten-metal-receiving chamber) is mixed with the 1st molten metal produced from the 1st melt raw material in the 1st melting chamber 12 into the mixed molten metal, with which the 1st retention chamber 13 is replenished. As a result, the previous surface levels of the molten metal in the chambers 11, 12, and 13 are recovered.

<2nd Melting Apparatus 1>

The 2nd melting apparatus 1 includes a 2nd introduction chamber 2, into which the 2nd melt raw material is introduced, a 2nd melting chamber 4, in which the 2nd melt raw material is received from the 2nd introduction chamber 2 and melted into a 2nd molten metal, a removal chamber 5, in which the 2nd molten metal is received from the 2nd melting chamber 4, and residual impurities, such as lumps, in the 2nd molten metal are removed by causing the impurities to float or sediment to obtain a clean 2nd molten metal, and a 2nd retention chamber 6, in which the 2nd molten metal deprived of the impurities is received and temporarily retained therein until feeding to the 1st melting apparatus 10.

The 2nd introduction chamber 2 and a circulation chamber 3 are connected with a 4'th transfer line W4'. This 4'th transfer line W4' may be, for example, in the form of a hollow pipe. A pipe acting as the 4'th transfer line W4' is designated as pipe W4'. The circulation chamber 3 and the 2nd melting chamber 4 are connected with a 5th transfer line W5. This 5th transfer line W5 may be, for example, in the form of a hollow pipe. A pipe acting as the 5th transfer line W5 is designated as pipe W5. The 2nd introduction chamber 2 and the 2nd melting chamber 4 are connected with a 1st transfer line W1. This 1st transfer line W1 may be, for example, in the form of a hollow pipe. A pipe acting as the 1st transfer line W1 is designated as pipe W1. For example, by means of rotation (clockwise rotation) of an impeller installed in the circulation chamber 3 for circulating molten metal, the 2nd molten metal and the 2nd melt raw material in the 2nd melting chamber 4 may be circulated through the pipe W1, the 2nd introduction chamber 2, the pipe W4', the circulation chamber 3, and the pipe W5 back to the 2nd melting chamber 4. In particular, when a fresh 2nd melt raw material is introduced into the 2nd introduction chamber 2, the temperature of the molten metal is lowered, so that it is preferred, by means of the rotation (counterclockwise rotation) of the impeller installed in the circulation chamber 3 for circulating molten metal, to circulate the 2nd molten metal and the 2nd melt raw material through the pipe W1, the 2nd melting chamber 4, the pipe W5, the circulation chamber 3, and the pipe W4' back to the 2nd introduction chamber 2, to thereby promote melting of the freshly introduced 2nd melt raw material into molten metal in the 2nd melting chamber 4, and to keep the temperature of the molten metal from lowering.

The 2nd molten metal and the 2nd melt raw material flown into the 2nd melting chamber 4 are heated with an immersion burner 7 installed inside the 2nd melting chamber 4, where the 2nd melt raw material melts into 2nd molten metal. The immersion burner 7 is configured to extend through a side wall of the 2nd melting chamber 4 into the inside thereof, and arranged below the surface of the molten metal retained in the 2nd melting chamber 4. This immersion burner 7 is a so-called horizontal immersion burner. The inside of this immersion burner 7 is as discussed above. Further, the immersion burner 7 has been discussed as a horizontal immersion burner, but may alternatively extend through the ceiling of the 2nd melting chamber 4 into the inside thereof, and arranged below the surface of the molten metal retained in the 2nd melting chamber 4. The immersion burner 7 may be a so-called vertical immersion burner. Note that the immersion burner may be replaced with an immersion heater.

As discussed above, in the 2nd melting chamber 4, the 2nd melt raw material is made into the 2nd molten metal. The 2nd molten metal and the 2nd melt raw material are flown from the 2nd introduction chamber 2 through the pipe W4' into the circulation chamber 3, and then from the circulation chamber 3 through the pipe W5 back into the 2nd melting chamber 4, so that a mixture of the 2nd molten metal and the 2nd melt raw material is contained in the 2nd melting chamber 4. According to the first embodiment, the 2nd melting chamber 4 is composed of two chambers, which are connected with a 6th transfer line W6. This 6th transfer line W6 may be, for example, in the form of a hollow pipe. A pipe acting as the 6th transfer line W6 is designated as pipe W6. This structure aims to sufficiently melt the 2nd melt raw material in the 2nd melting chamber 4 located closer to the 2nd introduction chamber, and then flow the resulting molten metal into the 2nd melting chamber 4 located closer to the removal chamber 5. Note that the 2nd melting chamber 4 is not limited to being composed of two chambers as in the first embodiment, and may be composed of three or more chambers, or may be composed of one chamber as in the sixth embodiment as will be discussed later.

The 2nd melting chamber 4 and the removal chamber 5 is connected with a 2nd transfer line W2. This 2nd transfer line W2 may be, for example, in the form of a hollow pipe. A pipe acting as the 2nd transfer line W2 is designated as pipe W2.

The 2nd molten metal in the 2nd melting chamber 4 flows through the interior space of the pipe W2 into the removal chamber 5.

In the removal chamber 5, the 2nd molten metal received therein is left to stand to float or sediment impurities, such as lumps, remaining in the molten metal, which is then removed to obtain a clear 2nd molten metal.

The removal chamber 5 and the 2nd retention chamber 6 are connected with a 3rd transfer line W3. This 3rd transfer line W3 may be, for example, in the form of a hollow pipe. A pipe acting as the 3rd transfer line W3 is designated as pipe W3.

The 2nd molten metal cleaned in the removal chamber 5 flows through the interior of the pipe W3 into the second retention chamber 6. It is preferred to install an immersion burner 7 in the removal chamber 5 for keeping the temperature of the 2nd molten metal from lowering. This immersion burner 7 is configured to extend through a side wall of the removal chamber 5 into the inside thereof as illustrated, and arranged below the surface of the molten metal retained in the removal chamber 5. This immersion burner 7 is a so-called horizontal immersion burner. The inside of this immersion burner 7 is as discussed above. Further, the immersion burner 7 has been discussed as a horizontal immersion burner, but may alternatively extend through the ceiling of the removal chamber 5 into the inside thereof, and arranged below the surface of the molten metal retained in the removal chamber 5. The immersion burner 7 may be a so-called vertical immersion burner. Note that the immersion burner may be replaced with an immersion heater.

FIG. 8A is a sectional view of the 2nd melting apparatus 1, taken along lines A-A' in FIG. 1. The 2nd introduction chamber 2, the circulation chamber 3 (not shown), the 2nd melting chambers 4, the removal chamber 5, and the 2nd retention chamber 6 (not shown) of the 2nd melting apparatus 1 are provided with a 2nd introduction chamber lid 2L, a circulation chamber lid 3L (not shown), 2nd melting chamber lids 4L, a removal chamber lid 5L, and a 2nd retention chamber lid 6L (not shown), respectively. The interior space of the respective chambers 2, 3, 4, 5, and 6 is preferably a hermetically sealed space devoid of air. Hermetically sealing the interior of the respective chambers 2, 3, 4, 5, and 6 to be devoid of air in this way reduces the chance for the molten metal to contact oxygen in the air to keep the molten metal from being oxidized partially.

In particular, it is preferred that, as shown in FIG. 8(B), a top opening 2*a* of the 2nd introduction chamber 2, a top opening 3*a* (not shown) of the circulation chamber 3, a top opening 4*a* of each 2nd melting chamber 4, a top opening 5*a* of the removal chamber 5, and a top opening 6*a* (not shown) of the 2nd retention chamber 6 individually have an upwardly flaring inner peripheral surface with the area of the opening gradually increasing upwards. The 2nd introduction chamber lid 2L, the circulation chamber lid 3L (not shown), the 2nd melt chamber lids 4L, the removal chamber lid 5L, and the 2nd retention chamber lid 6L (not shown) individually have an upwardly flaring outer peripheral surface corresponding to the upwardly flaring inner peripheral surface of the respective top openings 2*a*, 3*a*, 4*a*, 5*a*, and 6*a*, so as to be fittable from the above into the respective top openings 2*a*, 3*a*, 4*a*, 5*a*, and 6*a*. With the structures as discussed above, the 2nd introduction chamber lid 2L, the circulation chamber lid 3L, the 2nd melting chamber lids 4L, the removal chamber lid 5L, and the 2nd retention chamber lid 6L, when fit in the top openings 2*a*, 3*a*, 4*a*, 5*a*, and 6*a*, respectively, hardly form a gap, so that the molten metal in each chamber is more easily kept from being oxidized, even when the surface of the molten metal is raised up to the inner peripheral surface of the top opening 2*a*, 3*a*, 4*a*, 5*a*, and 6*a*, compared to a structure wherein an inner peripheral surface of each top opening 2*a*, 3*a*, 4*a*, 5*a*, and 6*a* is vertical and an outer peripheral surface of each of the 2nd introduction chamber lid 2L, the circulation chamber lid 3L, the 2nd melting chamber lids 4L, the removal chamber lid 5L, and the 2nd retention chamber lid 6L is vertical. Further, the top openings 2*a*, 3*a*, 4*a*, 5*a*, and 6*a* may easily be closed simply by fitting from the above the 2nd introduction chamber lid 2L, the circulation chamber lid 3L, the 2nd melting chamber lids 4L, the removal chamber lid 5L, and the 2nd retention chamber lid 6L, respectively, therein. Note that the 2nd introduction chamber 2 is covered with the lid, except when the 2nd melt raw material is introduced therein. The 2nd retention chamber 6 is covered with the 2nd retention chamber lid 6L, except when maintenance or inspection is conducted. In this regard, however, when the 2nd retention chamber 6 is provided with a connecting pipe W20 as will be discussed later, it is preferred to position the connecting pipe W20 spaced from the 2nd retention chamber lid 6L so as not to be expanded/contracted due to the molten metal temperature, or so as to keep the connecting pipe W20 from being damaged by external vibration.

Further, as shown in FIGS. 8(A) and 8(B), the 2nd melting apparatus 1 is preferably formed with a plurality of layers for the purpose of keeping the molten metals in the respective chambers 2, 3, 4, 5, and 6 from leaking outside, or keeping heat of the molten metals from conducting to outside (thermal insulation), or the like. In FIGS. 8(A) and 8(B), the 2nd melting apparatus 1 is shown to have a three-layered structure, but may have a two-layered or a four- or more layered structure. The innermost layer (inner layer) 1A is provided mainly for the purpose of keeping the molten metal from penetrating, and is composed of a material, such as alumina ($Al_2O_3$) or silicon dioxide ($SiO_2$) The outer most layer (outer layer) 1C is provided mainly for the purpose of thermal insulation, and is formed of a heat insulating material layer composed of, for example, a plurality of sheets of refractory fabric attached to each other. Positioned between the inner layer 1A and the outer layer 1C is a layer (intermediate layer) 1B, which is provided for the purpose of blocking the molten metal from reaching the outer wall when cracks are formed, and is composed of, for example, a refractory material having a higher thermal insulation capacity, compared to that of the inner layer 1A. Incidentally, the outer periphery, the bottom face, and part of the top face of the outer layer 1C is covered with, for example, an outer wall made of iron (steel shell).

<Connecting Pipe W20>

The connecting pipe W20 connects the 1st melting apparatus 10 and the 2nd melting apparatus 1. Specifically, this connecting pipe W20 connects the 1st introduction chamber 11 (molten-metal-receiving chamber) of the 1st melting apparatus 10 and the 2nd retention chamber 6 (molten-metal-tapping chamber) of the 2nd melting apparatus 1.

The material of the connecting pipe W20 is not particularly limited, and from the viewpoint of heat resistance and durability, may preferably be, for example, silicon nitride ($Si_3N_4$) ceramics, a refractory material containing silicon carbide (SiC) and silicon nitride ($Si_3N_4$) components, or a silicon carbide (SiC) refractory material. The connecting pipe W20 may be a single-layered pipe, or a two- or more layered pipe. For example, when the connecting pipe W20 is a three-layered pipe, the first layer located closest to the center (inner layer) may be a cylindrical layer of fine ceramics, the third layer located outermost (outer layer) may be a cylindrical layer of a blanket-like insulating material or the like, mainly composed of aluminum oxide ($Al_2O_3$) and silicon dioxide ($SiO_2$), and the second layer located between inner layer and the outer layer (intermediate layer) may be heating means embedded therebetween, such as an electric heater having a hot plate made of aluminum oxide ($Al_2O_3$) and silicon dioxide ($SiO_2$) ceramic fibers. In such a three-layered connecting pipe W20, molten metal passes through the hollow (interior space) formed closer to the center than the inner layer. With the three-layered structure, when the outside air temperature is low, the temperature of the molten metal flowing through the interior space lowers and the molten metal solidifies, thereby preventing solidified molten metal from adhering to the inner wall of the connecting pipe W20.

The connecting pipe W20 has a siphon function. Specifically, the system is configured that, with the interior of the connecting pipe W20 filled with liquid (e.g., the 2nd molten metal), when the surface of the 2nd molten metal retained in the 1st introduction chamber 11 of the 1st melting apparatus 10 is lowered, the 2nd molten metal retained in the 2nd retention chamber 6 of the 2nd melting apparatus 1 is automatically transferred through the interior space of the connecting pipe W20 into the 1st introduction chamber 11, by the siphon principle.

The arrangement of the connecting pipe W20 is not particularly limited, and may preferably be such that one end of the connecting pipe W20 is positioned below the surface of the 2nd molten metal retained in the 2nd retention chamber 6 of the 2nd melting apparatus 1, while the other end of the connecting pipe W20 is positioned below the surface of the 2nd molten metal retained in the 1st introduction chamber 11 of the 1st melting apparatus 10. It is particularly preferred to position each end of the connecting pipe W20 in the vicinity of the center of the molten metal, other than the vicinity of the surface of the molten metal in each chamber and the vicinity of each chamber bottom. In the vicinity of the surface of the molten metal, a film of oxide resulting from reaction with oxygen in the air is prone to form, whereas in the vicinity of each chamber bottom, heavy metals contained in the used non-ferrous metals (briquette material, machining chips, or the like), fresh non-ferrous metals (fresh material), or return scrap are sedimented. Thus, such positioning is for the purpose of avoiding contamination of the interior of the connecting pipe W20 with such oxide film or heavy metals entering together with the molten metal. Such positioning is also for the purpose of the siphon principle, with each end of the connecting pipe W20 positioned in the molten metal. Similarly, for practicing the siphon principle, it is preferred to fill also the interior space of the connecting pipe W20 with the molten metal.

In order to keep each end of the connecting pipe W20 below the surface of the molten metal, each chamber is preferably provided with a level sensor for detecting the surface level of the molten metal in the chamber. The system is preferably configured such that, when the level sensor detects the approach of at least one of the ends of the connecting pipe W20 to emerge above the surface of the molten metal, the 1st melt raw material and/or the 2nd melt raw material is additionally introduced to raise the surface level of the molten metal in each chamber. Note that, when the surface level of the molten metal in the 2nd retention chamber 6 (molten-metal-tapping chamber) is lower than the surface level of the molten metal in the 1st introduction chamber 11 (molten-metal-receiving chamber), undesirable backflow of the molten metal occurs. In order to avoid such defect, when the level sensor detects a risk of backflow, the siphon principle is deactivated. Note that the siphon principle is the phenomenon of molten metal retained in one chamber with a higher surface of a molten metal, transferring to another chamber with a lower surface of a molten metal, and the transfer of the molten metal ceases when the surface levels of the molten metal in the two chambers become substantially the same.

<1st Melt Raw Material and 2nd Melt Raw Material>

The 1st melt raw material preferably contains at least one of fresh non-ferrous metals and return scrap. The 2nd melt raw material preferably contains at least one of briquette material and machining chips.

It is particularly preferred to provide the 2nd introduction chamber 2 as a vortex chamber, under which a magnetic stirrer, or a gas injection system disclosed in Japanese Patent Application No. 2019-207478 by the Applicant of the present application is provided. This is for the purpose of generating a vortex in the molten metal in the vortex chamber to draw the briquette material and machining chips, which have a lower specific gravity than that of the molten metal, into the molten metal to reduce the duration of contact with external air, which discourages formation of oxides.

Second Embodiment

A second embodiment is shown in FIG. 2, wherein the connecting pipe W20 connects the 1st retention chamber 13 (molten-metal-receiving chamber) of the 1st melting apparatus 10 and the 2nd retention chamber 6 (molten-metal-tapping chamber) of the 2nd melting apparatus 1. The 2nd molten metal in the 2nd retention chamber 6 flows through the connecting pipe W20 into the 1st retention chamber 13 (molten-metal-receiving chamber). In this way, the residence time of the 2nd molten metal may be shortened to avoid oxidation of the molten metal. The remaining configurations are the same as in the first embodiment, so that explanations thereof are omitted.

Third Embodiment

A third embodiment is shown in FIG. 3, wherein the connecting pipe W20 connects each of the 1st introduction chamber 11 (molten-metal-receiving chamber) and the 1st retention chamber 13 (molten-metal-receiving chamber) of the 1st melting apparatus 10 with the 2nd retention chamber 6 (molten-metal-tapping chamber) of the 2nd melting apparatus 1. The 2nd molten metal in the 2nd retention chamber 6 flows through the connecting pipe W20 into the 1st introduction chamber 11 (molten-metal-receiving chamber) and/or the 1st retention chamber 13 (molten-metal-receiving chamber). The 2nd molten metal received in the 1st introduction chamber 11 (molten-metal-receiving chamber) may be re-heated in the 1st melting chamber 12 as in the first embodiment, whereas the 2nd molten metal received in the 1st retention chamber 13 (molten-metal-receiving chamber) may avoid oxidation due to its reduced residence time, as in the second embodiment. The remaining configurations are the same as in the first embodiment, so that explanations thereof are omitted.

Fourth Embodiment

A fourth embodiment is shown in FIG. 4, wherein the 2nd introduction chamber 2 and a 2nd melting chamber 4 are connected with a 4th transfer line W4. This 4th transfer line W4 may be, for example, in the form of a hollow pipe. In the following, an embodiment is described in which the 4th transfer line W4 is a pipe, which is designated as pipe W4. In the 2nd introduction chamber 2, the 2nd molten metal and the 2nd melt raw material are present in mixture. The 2nd molten metal and the 2nd melt raw material in the 2nd introduction chamber 2 flow through the interior space of the pipe W4 into the 2nd melting chamber 4. The 2nd melting chamber 4 and the 2nd introduction chamber 2 are also connected with the pipe W1. In this way, the molten metal can circulate counterclockwise from the 2nd melting chamber 4 through the pipe W4, the 2nd introduction chamber 2, and the pipe W1 back into the 2nd melting chamber 4 or, in reverse, can circulate clockwise. The circulation moves the solid feedstock to facilitate its melting into a liquid molten metal, and to make uniform the distribution of physical properties, such as temperature and viscosity of the molten metal. Further, the 2nd introduction chamber 2, the 2nd melting chambers 4, the removal chamber 5, and the 2nd retention chamber 6 of the 2nd melting apparatus 1 are provided with the 2nd introduction chamber lid 2L, the 2nd melting chamber lids 4L, the removal chamber lid 5L, and the 2nd retention chamber lid 6L, respectively. The interior space of the respective chambers 2, 4, 5, and 6 is preferably a hermetically sealed space devoid of air. The remaining configurations are the same as in the first embodiment, so that explanations thereof are omitted.

Fifth Embodiment

A fifth embodiment is shown in FIG. 5, wherein the 1st introduction chamber 11 and the 1st melting chamber 12 are connected with a 14th transfer line W14. This 14th transfer line W14 may be, for example, in the form of a hollow pipe. A pipe acting as the 14th transfer line W14 is designated as pipe W14. The 1st introduction chamber 11 and a circulation chamber 14 are connected with a 13th transfer line W13. This 13th transfer line W13 may be, for example, in the form of a hollow pipe. A pipe acting as the 13th transfer line W13 is designated as pipe W13. The circulation chamber 14 and the 1st melting chamber 12 are connected with an 11th transfer line W11. This 11th transfer line W11 may be, for example, in the form of a hollow pipe. A pipe acting as the 11th transfer line W11 is designated as pipe W11. The circulation chamber 14 may be provided with an impeller for circulating molten metal. In this way, the molten metal effectively circulates through the 1st introduction chamber 11, the 1st melting chamber 12, and the circulation chamber 14 to facilitate melting of the 1st melt raw material and to produce a homogenous molten metal not contaminated with oxides (or contaminated still less with oxides). Discussing this circulation in detail, for example, by means of rotation (normal or reverse rotation) of the impeller for circulating molten metal installed in the circulation chamber 14, the mixed molten metal (a mixture of the 1st molten metal and the 2nd molten metal) in the 1st melting chamber 12 is transferred through the pipe W14, the 1st introduction chamber 11, the pipe W13, the circulation chamber 14, and the pipe W11 back into the 1st melting chamber 12, or transferred through the reverse path back into the 1st melting chamber 12. Note that the embodiment of the 2nd melting apparatus 1 is not particularly limited. For example, the 2nd melting apparatus 1 may be the same as the 2nd melting apparatus 1 of any of the first to fourth, and sixth embodiments.

Sixth Embodiment

A sixth embodiment is shown in FIG. 7, wherein the two 2nd melting chambers 4 in the fourth embodiment are replaced with one melting chamber 4. Only one chamber is easier to clean in maintenance.

<Miscellaneous>

In the above description, the immersion burner 7 was taken as an example, but other burners may also be used. Also, the burner may be replaced with a heater.

Effects of Embodiments

For transporting molten metal from the 2nd melting apparatus 1 to the 1st melting apparatus 10, it is conceivable to scoop the 2nd molten metal in the 2nd melting apparatus 1 with a ladle, transport the ladle with a forklift, and pour out the molten metal into the 1st melting apparatus 10. However, this may bring the 2nd molten metal into contact with air during the molten metal transportation, to produce a large amount of oxides, leading to deterioration of final product quality. Further, during the transportation, the molten metal may splatter or the exhaust gas from the forklift may permeate the factory, which may deteriorate the working environment of workers.

In the various embodiments, transferring the 2nd molten metal through the connecting pipe W20 may significantly reduce the amount of oxides generated during the transfer, which leads to improvement in final product quality. In addition, deterioration of working environment of workers may be avoided. Further, human intervention is not required in the transfer, which contributes to reduction of labor cost.

Moreover, the 1st molten metal and the 2nd molten metal may be mixed at predetermined weight proportions, as the two components are mixed in the form of molten metals.

DESCRIPTION OF REFERENCE NUMERALS

1: 2nd melting apparatus
2: 2nd introduction chamber
2*a*: top opening of 2nd introduction chamber
2L: 2nd introduction chamber lid
3: circulation chamber
3*a*: top opening of circulation chamber
3L: circulation chamber lid
4: 2nd melting chamber
4*a*: top opening of 2nd melting chamber
4L: 2nd melting chamber lid
5: removal chamber
5*a*: top opening of removal chamber
5L: removal chamber lid
6: 2nd retention chamber
6*a*: top opening of 2nd retention chamber
6L: 2nd retention chamber lid
7: burner (immersion burner/heater)
10: 1st melting apparatus
11: 1st introduction chamber
11*a*: top opening of 1st introduction chamber
11L: 1st introduction chamber lid
12: 1st melting chamber
12*a*: top opening of 1st melting chamber
12L: 1st melting chamber lid
13: 1st retention chamber
13*a*: top opening of 1st retention chamber
13L: 1st retention chamber lid
14: circulation chamber
W1: 1st transfer line
W2: 2nd transfer line
W3: 3rd transfer line
W4: 4th transfer line
W4': 4'th transfer line
W5: 5th transfer line
W6: 6th transfer line
W11: 11th transfer line
W12: 12th transfer line
W13: 13th transfer line
W14: 14th transfer line
W20: connecting pipe

The invention claimed is:

1. A molten metal mixing system, comprising:

1 st melting apparatus for melting by heating a 1st melt raw material to produce a 1st molten metal, 2nd melting apparatus for melting by heating a 2nd melt raw material to produce a 2nd molten metal, and a connecting pipe connecting the 1st melting apparatus and the 2nd melting apparatus, wherein the system is configured to transfer the 2nd molten metal produced in the 2nd melting apparatus through interior space of the connecting pipe to the 1st melting apparatus to mix with at least one of the 1st melt raw material and the 1st molten metal in the 1st melting apparatus, wherein the 2nd melting apparatus has a molten-metal-tapping chamber for retaining therein the 2nd molten metal to be transferred to the 1st melting apparatus, wherein the 1st melting apparatus has a molten-metal-receiving chamber for retaining therein the 2nd molten metal received from the 2nd melting apparatus, wherein the system is configured that, when part of the 2nd molten metal retained in the molten-metal-receiving chamber is discharged out of the molten-metal-receiving chamber to lower a surface of a molten metal in the molten-metal-receiving chamber, the 2nd molten metal in the molten-metal-tapping chamber is transferred through the connecting pipe into the molten-metal-receiving chamber by siphon principle, wherein one end of the connecting pipe is positioned below a surface of the 2nd molten metal in the molten-metal-tapping chamber, wherein another end of the connecting pipe is positioned below the surface of the molten metal in the molten-metal-receiving chamber, and wherein the system is configured such that the 2nd molten metal is transferred from the molten-metal-tapping chamber into the molten-metal-receiving chamber without contacting air through the interior space of the connecting pipe.

2. The molten metal mixing system according to claim 1, wherein the 1st melting apparatus including:

an introduction chamber into which the 1st melt raw material is introduced, and a melting chamber in which the 1st melt raw material is received from the introduction chamber, and the 1st melt raw material thus received is melted by heating to produce the 1st molten metal, wherein the system is configured to use the introduction chamber as the molten-metal-receiving chamber to mix the 1st melt raw material and the 2nd molten metal in the introduction chamber.

3. The molten metal mixing system according to claim 1, wherein the 1st melting apparatus including:

a melting chamber for melting by heating the 1st melt raw material to produce the 1st molten metal, and a retention chamber in which the 1st molten metal is received from the melting chamber and retained, wherein the system is configured to use the retention chamber as the molten-metal-receiving chamber to mix the 1st molten metal and the 2nd molten metal in the retention chamber.

4. The molten metal mixing system according to claim 1, wherein the 1st melt raw material comprises at least one of fresh non-ferrous metals and return scrap, and wherein the 2nd melt raw material comprises at least one of briquette material and machining chips.

5. The molten metal mixing system according to claim 2, wherein the 1st melting apparatus including:

a melting chamber for melting by heating the 1st melt raw material to produce the 1st molten metal, and a retention chamber in which the 1st molten metal is received from the melting chamber and retained, wherein the system is configured to use the retention chamber as the molten-metal-receiving chamber to mix the 1st molten metal and the 2nd molten metal in the retention chamber.

6. The molten metal mixing system according to claim 2, wherein the 1st melt raw material comprises at least one of fresh non-ferrous metals and return scrap, and wherein the 2nd melt raw material comprises at least one of briquette material and machining chips.

7. The molten metal mixing system according to claim 3, wherein the 1st melt raw material comprises at least one of fresh non-ferrous metals and return scrap, and wherein the 2nd melt raw material comprises at least one of briquette material and machining chips.

8. The molten metal mixing system according to claim 1, further comprising a level sensor provided in the molten-metal-tapping chamber for detecting a level of the surface of the 2nd molten metal therein, wherein the level sensor provided in the molten-metal-tapping chamber detects lowering of the surface of the 2nd molten metal in the molten-metal-tapping chamber down to a vicinity of the one end of the connecting pipe.

9. The molten metal mixing system according to claim 1, further comprising a level sensor provided in the molten-metal-receiving chamber for detecting a level of the surface of the molten metal therein, wherein the level sensor provided in the molten-metal-receiving chamber detects lowering of the surface of the molten metal in the molten-metal-receiving chamber down to a vicinity of the another end of the connecting pipe.

10. The molten metal mixing system according to claim 8, further comprising a level sensor provided in the molten-metal-receiving chamber for detecting a level of the surface of the molten metal therein, wherein the level sensor provided in the molten-metal-receiving chamber detects lowering of the surface of the molten metal in the molten-metal-receiving chamber down to a vicinity of the another end of the connecting pipe.

11. The molten metal mixing system according to claim 1, wherein an interior space of the molten-metal-tapping chamber is a hermetically sealed space devoid of air.

12. The molten metal mixing system according to claim 1, wherein an interior space of the molten-metal-receiving chamber is a hermetically sealed space devoid of air.

13. The molten metal mixing system according to claim 11, wherein an interior space of the molten-metal-receiving chamber is a hermetically sealed space devoid of air.

14. The molten metal mixing system according to claim 1, wherein the molten-metal-tapping chamber has a top opening, the top opening of the molten-metal-tapping chamber having an upwardly flaring inner peripheral surface with an area of the opening gradually increasing upwards, and wherein a lid is fit in the top opening of the molten-metal-tapping chamber, the lid having a downwardly tapering outer peripheral surface with its cross-sectional area gradually decreasing downwards corresponding to the inner peripheral surface of the top opening of the molten-metal-tapping chamber.

15. The molten metal mixing system according to claim 1, wherein the molten-metal-receiving chamber has a top opening, the top opening of the molten-metal-receiving chamber having an upwardly flaring inner peripheral surface with an area of the opening gradually increasing upwards, and wherein a lid is fit in the top opening of the molten-metal-receiving chamber, the lid having a downwardly tapering outer peripheral surface with its cross-sectional area gradually decreasing downwards corresponding to the inner peripheral surface of the top opening of the molten-metal-receiving chamber.

16. The molten metal mixing system according to claim 14, wherein the molten-metal-receiving chamber has a top opening, the top opening of the molten-metal-receiving chamber having an upwardly flaring inner peripheral surface with an area of the opening gradually increasing upwards, and wherein a lid is fit in the top opening of the molten-metal-receiving chamber, the lid having a downwardly tapering outer peripheral surface with its cross-sectional area gradually decreasing downwards corresponding to the inner peripheral surface of the top opening of the molten-metal-receiving chamber.

* * * * *